US006948441B2

(12) United States Patent
Levine

(10) Patent No.: US 6,948,441 B2
(45) Date of Patent: Sep. 27, 2005

(54) SHOCK LIMITED HYDROFOIL SYSTEM

(76) Inventor: Gerald A. Levine, 9525 Majestic Way, Boynton Beach, FL (US) 33437

( * ) Notice: Subject to any disclaimer, the term of this patent is extended or adjusted under 35 U.S.C. 154(b) by 0 days.

(21) Appl. No.: 10/364,589

(22) Filed: Feb. 10, 2003

(65) Prior Publication Data

US 2004/0154520 A1 Aug. 12, 2004

(51) Int. Cl.[7] ..... B63B 1/26
(52) U.S. Cl. ..... 114/274
(58) Field of Search ..... 114/274, 275, 114/278, 279, 280

(56) References Cited

U.S. PATENT DOCUMENTS

| | | | | | |
|---|---|---|---|---|---|
| 1,073,567 | A | * | 9/1913 | Burney | 244/105 |
| 1,410,876 | A | * | 3/1922 | Bell et al. | 114/274 |
| 2,081,868 | A | * | 5/1937 | Hampden | 114/274 |
| 2,139,303 | A | | 12/1938 | Grunberg | |
| 2,584,347 | A | | 2/1952 | Hazard | |
| 2,890,672 | A | * | 6/1959 | Boericke, Jr. | 114/274 |
| 2,914,014 | A | | 11/1959 | Carl et al. | |
| 3,081,728 | A | | 3/1963 | Wilterdink et al. | |
| 3,092,062 | A | | 6/1963 | Savitsky | |
| 3,139,059 | A | | 6/1964 | Hanford, Jr. | |
| 3,149,601 | A | * | 9/1964 | Lang | 114/275 |
| 3,175,526 | A | | 3/1965 | Johnson, Jr. et al. | |
| 3,357,390 | A | | 12/1967 | Wray, Jr. | |
| 3,364,892 | A | | 1/1968 | Persson et al. | |
| 3,693,570 | A | | 9/1972 | Erlykin et al. | |
| 3,704,442 | A | | 11/1972 | Wright | |
| 3,785,319 | A | | 1/1974 | Danforth | |
| 3,789,789 | A | | 2/1974 | Cleary | |
| 3,800,727 | A | | 4/1974 | Stark et al. | |
| 3,804,048 | A | | 4/1974 | Cline | |
| 3,842,774 | A | | 10/1974 | Kinder | |
| 3,886,884 | A | | 6/1975 | Stark et al. | |
| 3,899,987 | A | | 8/1975 | Wright et al. | |
| 3,902,444 | A | | 9/1975 | Stark | |
| 3,910,216 | A | | 10/1975 | Shultz | |
| 3,946,688 | A | | 3/1976 | Gornstein et al. | |
| 3,958,522 | A | | 5/1976 | Harang et al. | |
| 3,964,417 | A | | 6/1976 | Williams et al. | |
| 3,977,348 | A | | 8/1976 | Bordat et al. | |
| 4,027,835 | A | | 6/1977 | Sachs | |
| 4,056,074 | A | | 11/1977 | Sachs | |
| 4,159,690 | A | | 7/1979 | Farris | |
| 4,178,871 | A | | 12/1979 | Hirsch | |
| 4,182,256 | A | | 1/1980 | Scott et al. | |
| 4,207,830 | A | | 6/1980 | Wankel | |
| 4,208,980 | A | * | 6/1980 | Henkel | 114/274 |
| 4,962,718 | A | | 10/1990 | Gornstein et al. | |
| 5,117,776 | A | | 6/1992 | Thorpe | |
| 5,373,800 | A | | 12/1994 | Steinberg | |
| 5,469,801 | A | | 11/1995 | Payne | |
| 6,095,076 | A | | 8/2000 | Nesbitt | |
| 6,164,235 | A | | 12/2000 | Hoppe | |
| 6,439,148 | B1 | | 8/2002 | Lang | |

* cited by examiner

*Primary Examiner*—Andrew D. Wright
(74) *Attorney, Agent, or Firm*—Christopher & Weisberg, P.A.

(57) ABSTRACT

A shock mitigation system for a hydrofoil marine craft is provided, the shock mitigation system includes a pair of stacked lifting bodies, where an upper lifting body is used to provide initial lift for the craft. To mitigate the wave effects on the craft when operating at cruise speed, the distance between the upper lifting bodies and the waterline is proportionally related to the operational wave height. When operated within the selected operational parameters, the distance between the upper lifting bodies and waterline prevents the upper lifting bodies from becoming wetted and producing sudden increases in lift from wave impact.

17 Claims, 6 Drawing Sheets

SHOCK LIMITED HYDROFOIL SYSTEM

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates to hydrofoil marine vehicles and more particularly to a hydrofoil configuration to mitigate the effects of wave shock.

BACKGROUND OF THE INVENTION

The hydrofoil vehicle is analagous to an aircraft, where the wings operate under water. The basic principle of the hydrofoil concept is to lift a craft's hull out of the water and support it dynamically on the submerged wings, i.e. hydrofoils. The hydrofoils can reduce the effect of waves on the craft and reduce the power required to attain modestly high speeds. As the craft's speed is increased the water flow over the hydrofoils increase, generating a lifting force and causing the craft to rise. For a given speed the craft will rise until the lifting force produced by the hydrofoils equals the weight of the craft.

In a typical arrangement, struts connect the hydrofoils to the craft's hull, where the struts have sufficient length to support the hull free of the water surface when operating at cruise speeds. As shown in FIGS. 1*a*–1*c*, the basic choices in hydrofoil and strut arrangement are conventional, canard, or tandem. In an example of a conventional arrangement, as shown in FIG. 1*b*, a pair of struts and hydrofoils are positioned fore of the craft's center of gravity, symmetrical about the craft's longitudinal centerline, and a single strut and hydrofoil is positioned aft of the craft's center of gravity along the craft's longitudinal centerline. In a canard arrangement, as shown in FIG. 1*c*, a single strut and hydrofoil is positioned fore of the craft's center of gravity along the craft's longitudinal centerline, and a pair of struts and hydrofoils are positioned aft of the craft's center of gravity, symmetrical about the craft's longitudinal centerline.

Alternatively, the pairs of struts can include a single hydrofoil, spanning the beam of the craft. Generally, craft are considered conventional or canard if 65% or more of the weight is supported on the fore or the aft foil respectively.

In a tandem arrangement, as shown in FIG. 1*a*, pairs of struts and hydrofoils are positioned fore and aft of the craft's center of gravity and symmetrically about the craft's longitudinal centerline. Alternatively, the pairs of struts can include a single hydrofoil, spanning the beam of the craft. If the weight is distributed relatively evenly on the fore and aft hydrofoils, the configuration would be described as tandem.

The hydrofoil's configuration on the strut can be divided into two general classifications, fully submerged and surface piercing. Fully submerged hydrofoils are configured to operate at all times under the water surface. The principal and unique operational capability of craft with fully submerged hydrofoils is the ability to uncouple the craft to a substantial degree from the effect of waves. This permits a hydrofoil craft to operate foil borne at high speed in sea conditions normally encountered while maintaining a comfortable motion environment.

However, the fully submerged hydrofoil system is not self-stabilizing. Consequently, to maintain a specific height above the water, and a straight and level course in pitch and yaw axes, usually requires an independent control system. The independent control system varies the effective angle of attack of the hydrofoils or adjusts trim tabs or flaps mounted on the foils, changing the lifting force in response to changing conditions of craft speed, weight, and sea conditions.

In the surface piercing concept, portions of the hydrofoils are configured to extend through the air/sea interface when foil borne. As speed is increased, the lifting force generated by the water flow over the submerged portion of the hydrofoils increases, causing the craft to rise and the submerged area of the foils to decrease. For a given speed the craft will rise until the lifting force produced by the submerged portion of the hydrofoils equals the weight of the craft. However, because a portion of the surface-piercing hydrofoil is always in contact with the water surface, and therefore the waves, the surface-piercing foil is susceptible to the adverse affect of wave action. The impact of the waves can impart sudden, large forces onto the struts and craft, resulting in an erratic and dangerous motion environment.

Additionally, hydrofoil configurations can include a stack foil, or ladder foil, arrangement, where upper foils are used to provide lift at lower speed, initially raising the craft above the waterline. As the craft's speed is increased, the lower foils produce sufficient lift to support the weight of the craft, further raising the upper foils above the waterline to the cruise height. However, when a wave impacts the craft the upper foil can be instantaneously wetted, producing a sudden increase in lift. The sudden increase in lift produces a jarring impact on the craft, and in some instance can be sufficient enough to instantaneously raise the entire craft, including the main foils, above the waterline.

A hydrofoil vehicle is configured to operate at a particular cruise speed. The cruise speed is the speed at which the total lifting force produced by the hydrofoils equals the all up weight of the hydrofoil vehicle. Operating at speeds greater than the cruise speed can cause the hydrofoils to produce excessive lift, resulting in a cyclic skipping action. At speeds less than the cruise speed, when the hydrofoils do not produce sufficient lift to raise vehicle results in the hull crashing into the water.

Propulsion systems for hydrofoil vehicles can include both water and air propulsion systems. In an exemplary arrangement of a water propulsion system, a water propeller provides the propulsive force, where a drive shaft operably connects the water propeller to an engine. Alternatively, a water jet can be used to provide the propulsive force, where water is funneled through a water intake into the water jet. The water jet accelerates the water, expelling the water through the outlet creating a propulsive force. Air propulsion systems can include for example, air propeller or jet engines. As shown in U.S. Pat. No. 4,962,718 to Gornstein et al., an air propeller is positioned on the deck of the craft and operatively connected to an engine.

SUMMARY OF THE INVENTION

The present invention provides a shock mitigation system for hydrofoil marine craft. The shock mitigation system includes a pair of stacked lifting bodies, where an upper lifting body is used to provide initial lift for the craft. As the craft's speed is increased, the lower lifting body produces sufficient lift to raise the craft and upper lifting body to a specified cruising height. The craft is configured to operate at this selected cruising height and at a maximum wave height, where the wave height is defined as the distance between the crest and trough of a wave. To mitigate the wave effects on the craft when operating at the selected cruise height, the distance between the upper lifting body and the waterline is proportionally related to the maximum wave height to be encountered. When used within the operational parameters, the distance between the upper lifting body and waterline prevents the upper lifting body from becoming wetted and producing sudden increases in lift from wave impact.

The hydrofoil marine craft is configured to operate at a selected cruise height above the waterline. This selected cruise height can be maintained by adjusting the thrust output of the propulsion system. To raise the craft to the selected cruise height, the thrust output is increased. Similarly, to lower the craft to the selected cruise height, the thrust output is decreased.

Alternatively, the cruise height can be maintained by adjusting the lower lifting body's angle of attack. An increase in the angle of attack will result in an increase in lift, raising the craft to the selected cruise height. A decrease in the angle of attack will result in a decrease in lift, lowering the craft to the selected cruise height.

Advantageously, the above system can also be used to increase or decrease the cruise speed, while maintaining the selected cruise height. For example, a decrease in the angle of attack and an increase in the thrust will result in a higher cruise speed, while maintaining the selected cruise height. Similarly, an increase in the angle of attack and a decrease in the thrust will result in a lower cruise speed, while maintaining the selected cruise height.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present invention advantageously provides a shock mitigation system for hydrofoil marine craft. The shock mitigation system includes a pair of stacked lifting bodies, where an upper lifting body is used to provide initial lift for the craft. As the craft's speed is increased, the lower lifting body produces sufficient lift to raise the craft and upper lifting body above the waterline, reaching a targeted cruise height. The craft is configured to operate at a selected maximum wave height, where wave height is defined as the distance between the crest and trough of a wave. To mitigate the wave effects on the craft when operating at the cruise height, the distance between the upper lifting body and the waterline is proportionally related to the maximum wave height. When used within the operational parameters, the distance between the upper lifting body and the waterline prevents the upper lifting body from becoming wetted and producing sudden increases in lift from wave impacts.

Figure 1A:
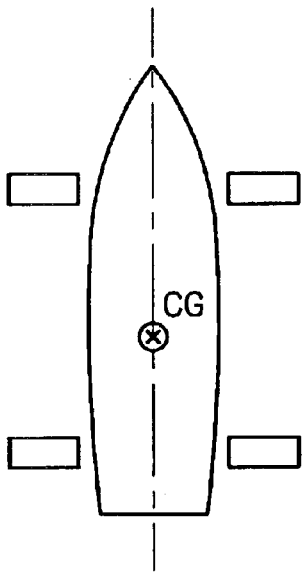
Fig. 1A (Prior Art)
FIGS. 1*a*–1*c* are prior art hydrofoil configurations of hydrofoil marine craft.
Figure 1B:
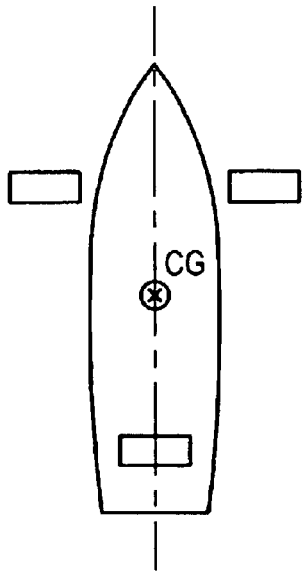
Fig. 1B (Prior Art)
Figure 1C:
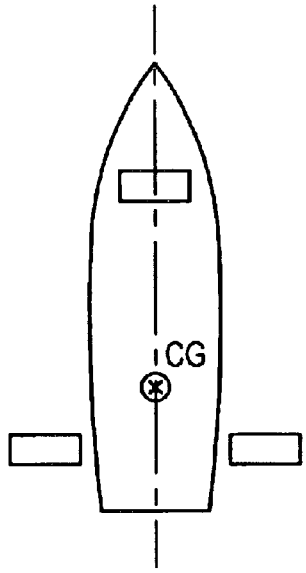
Fig. 1C (Prior Art)
Figure 2:
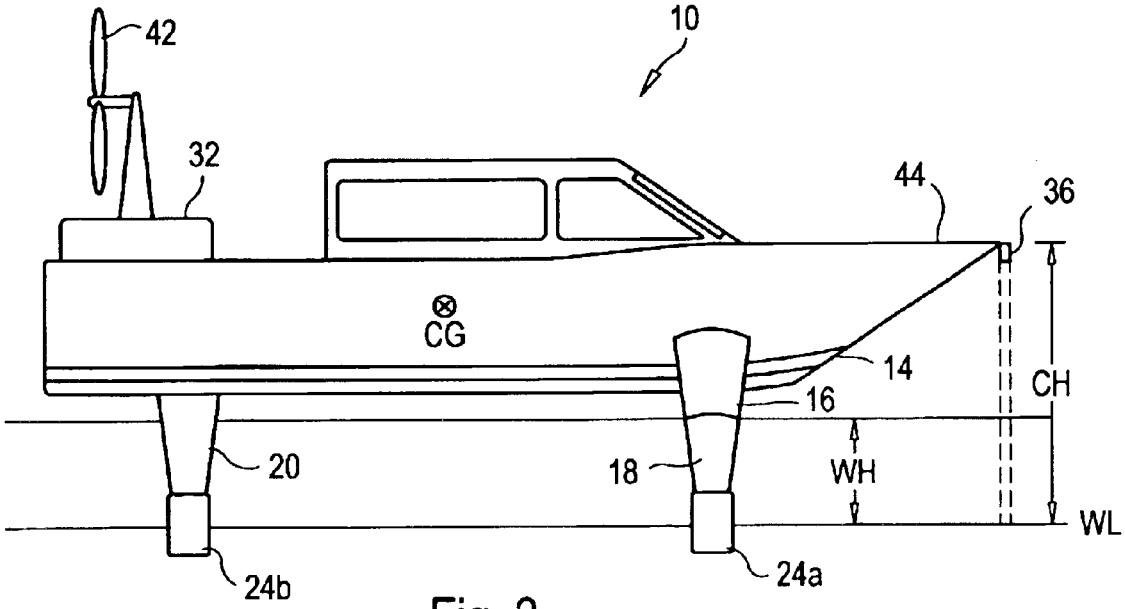
FIG. 2 is a side view of the hydrofoil marine craft of the present invention.
Figure 3:
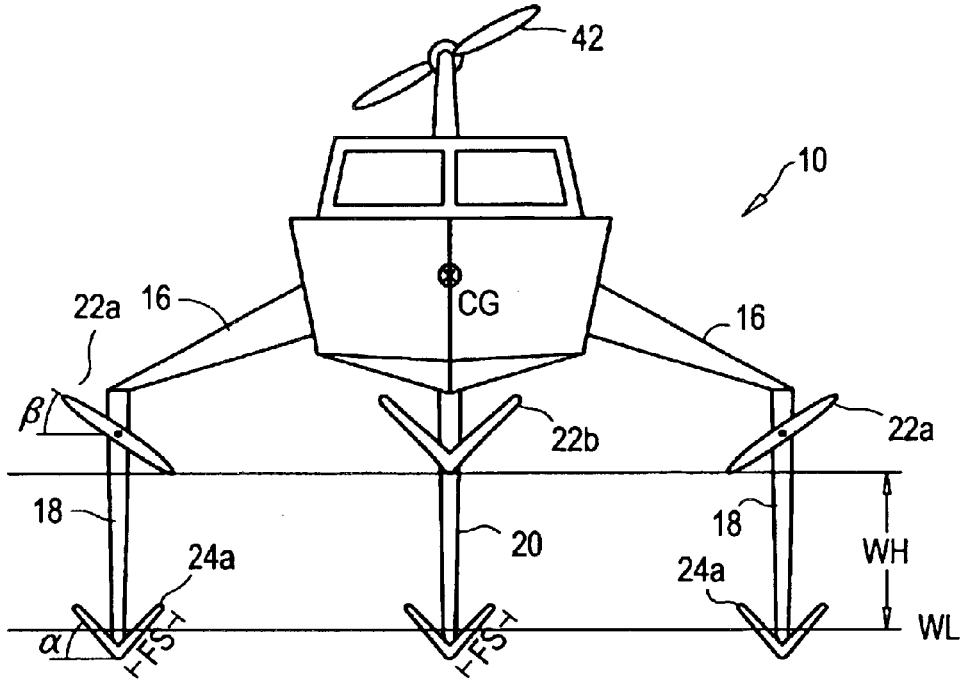
FIG. 3 is a front view of the hydrofoil marine craft of the present invention.

In an exemplary embodiment, as shown in FIGS. 2 and 3, the hydrofoil marine craft 10 includes a conventional hydrofoil arrangement, having a pair of lifting bodies positioned fore of the craft's center of gravity "CG", symmetrical about the craft's longitudinal centerline, and lifting bodies positioned aft of the craft's center of gravity along the craft's longitudinal centerline. Each of the fore lifting bodies is attached to the craft's hull 14 with a support structure, which includes a strut 16 and a pylon 18. The struts 16 are affixed to the craft's hull 14 and extend laterally outward from the craft 10. The pylons 18 are affixed to the ends of the struts 16, opposite the craft 10, and extend substantially, vertically downward, where the lifting bodies are operably connected to the pylons 18. The strut 16 can be used to provide increased roll stability to the craft 10, where the lateral distance that the strut 16 extends is a function of the craft's 10 specific configuration, depending on the craft's 10 operational parameters. Alternatively, the pylons 18 can be affixed directly to the hull 14. The aft lifting bodies are attached to the craft's hull 14 with a center pylon 20, where the center pylon 20 is affixed to the hull 14 along the craft's centerline and the lifting bodies are operably connected to the center pylon 20.

In an exemplary embodiment, as shown in FIG. 3, the upper lifting bodies are takeoff foils 22*a* and 22*b* and lower lifting bodies are main foils 24*a* and 24*b*. The takeoff foils 22*a* and 22*b* are positioned on the pylons 18 and 20 above the main foils 24*a* and 24*b* and are used to provide lift at lower speeds, initially raising the craft 10 above the waterline "WL". As the speed of the craft 10 increases to the cruising speed, the main foils 24*a* and 24*b* produce sufficient lift to support the weight of the craft 10, further raising the craft 10 and takeoff foils 22*a* and 22*b* above the waterline "WL" to the targeted cruising height. The distance between the main foils' 24*a* and 24*b* mid span and the takeoff foils 22*a* and 22*b* is such that at the target cruising height, a distance "WH" is maintained between the lowest sections of the lifting surfaces of the takeoff foils 22*a* and 22*b* and the waterline "WL". The distance "WH" is an operational parameter, dependent on the selected maximum operational wave height. For example, the distance "WH" is substantially equal to one-half the wave height.

The fore main foils 24*a* are surface piercing foils, where at the target cruise height a portion of the fore main foil 24*a* extends through and above the waterline "WL." The fore main foils 24*a* each include a pair of dihedral foil sections symmetrically attached to the pylon 18 at an angle $\alpha$ from the horizontal axis, where the angle $\alpha$ can be between about 15 degrees and 50 degrees. At the target cruise height, the submerged portion of the fore main foils 24*a* can be from 33% to 80% of the foil's span length "FS", and in an embodiment can be about 50% of the main foil's span length "FS".

The fore takeoff foils 22*a* are dihedral foil sections asymmetrically attached to the pylons 18 at an angle β from the horizontal axis, where the fore takeoff foils 22*a* are directed inward and downward, towards the craft's 10 center line. The dihedral angle β can be between about 10 degrees and 45 degrees. The distance "WH" is measured from the lower tip of the takeoff foils 22*a* to the water line "WL."

The aft main foils 24*b* are surface piercing foils, where at the target cruise height a portion of the aft main foil 24*b* extends through and above the waterline "WL." The aft main foils 24*b* include a pair of dihedral foil sections symmetrically attached to the center pylon 20. The dihedral angle of the aft main foil 24*b* is configured such that the upper most elevation of the aft main foil 24*b* tips matches the upper most elevation of the fore main foil 24*a* tips, and the lowest elevation of the aft main foil 24*b* matches the lowest most elevation of the fore main foil 24*a*. At the targeted cruise height, the submerged potion of the aft main foil 24*a* can be from 33% to 80% of the foil's span length "FS", and in an embodiment can be about 50% of the main foil's span length "FS".

The aft takeoff foil 22*b* includes a pair of dihedral foil sections symmetrically attached to the center pylon 20. The dihedral angle of the aft takeoff foil 22*b* is configured such that the upper most elevation of the aft takeoff foil 22*b* tips matches the upper most elevation of the fore takeoff foil 22*a* tips, and the lowest elevation of the aft takeoff foil 22*b* matches the lowest most elevation of the fore takeoff foils 22*a*. The distance "WH" is measured from the lower portion of the interface between the aft takeoff foil 22*b* and the center pylon 20 to the water line "WL."

The shock mitigation system of the present invention maintains the lift equilibrium between the fore and aft main foils 24*a* and 24*b* during wave impact. As shown in FIG. 3, at a selected cruise height the waterline "WL" is positioned at about one-half the span of the fore and aft main foils 24*a* and 24*b*, where the end tips of the fore and aft main foils 24*a* and 24*b* extend above the waterline "WL". As such, the lift provided by the submerged portions of the fore and aft main foils 24*a* and 24*b* is in a state of equilibrium. When a wave impacts the craft 10, additional portions of the fore and aft main foils 24*a* and 24*b* will be temporary submerged, providing an instantaneous increase in lift. To maintain the lift equilibrium between the fore and aft main foils 24*a* and 24*b*, the ratio of instantaneous lift provided by the fore and aft main foils 24*a* and 24*b* should be substantially equal to the lift ratio of the fore and aft main foils 24*a* and 24*b* in calm seas.

Shock mitigation occurs when a wave washes completely over the main foils 24*a* and 24*b*. The normal lift equals the all-up weight when the foils are 50% wetted. When totally wetted, the maximum lift is limited to twice the all-up weight—capping the lift force at +100% of the designed lift. A wave trough can uncover the foil reducing the lift to zero, capping the lift at minus 100%. This shock mitigation to plus or minus 100% is intrinsic to the present invention.

Figure 4:
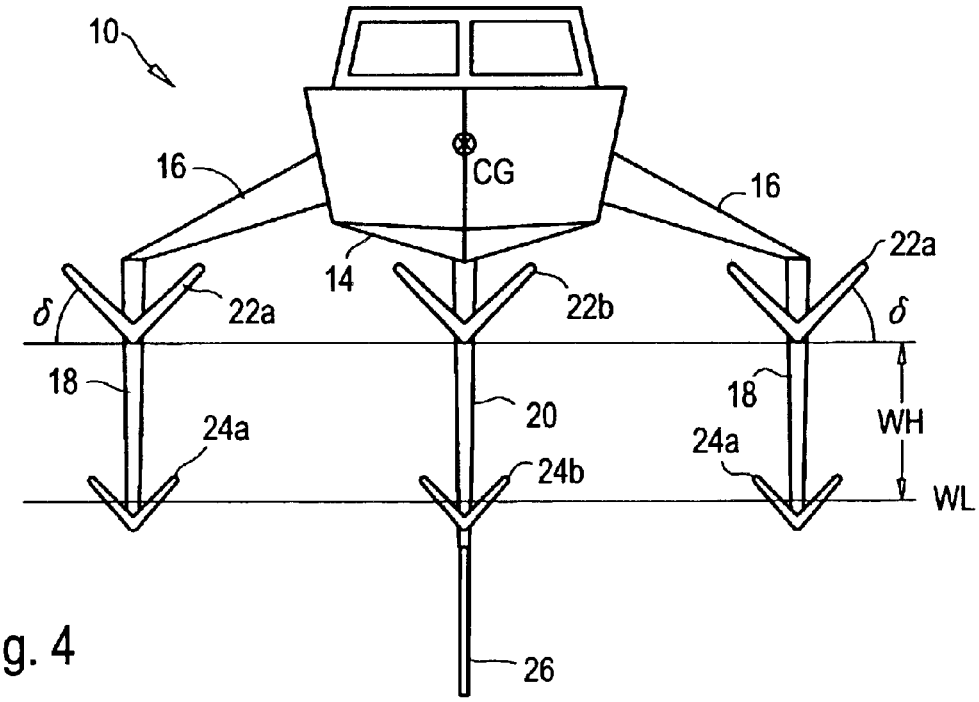
FIG. 4 is a front view of an alternative hydrofoil marine craft configuration of the present invention, including a vertical stabilizer.

Additionally, as show in FIG. 4, the fore takeoff foils 22*a* can include a pair of dihedral foil sections symmetrically attached to the pylon 18 at a dihedral angle δ from the horizontal axis, where the angle δ can be between about 10 degrees and 45 degrees. The distance "WH" is measured from the lower portion of the interface between the fore takeoff foils 22*a* and the pylons 18 to the waterline "WL."

In a further exemplary embodiment, at least one vertical stabilizer 26 is affixed to and extends from at least one of the pylons 18 and 20. As shown in FIG. 4, a vertical stabilizer 26 is affixed to and extends from the aft center pylon 20, where the vertical stabilizer 26 provides additional stability to prevent the craft 10 from yawing. The vertical stabilizer 26 can additional dampen roll. Alternatively, the vertical stabilizer 26 is retractable, where the vertically stabilizer, for example, is drawn up into the pylons 18 and 20.

Figure 5:
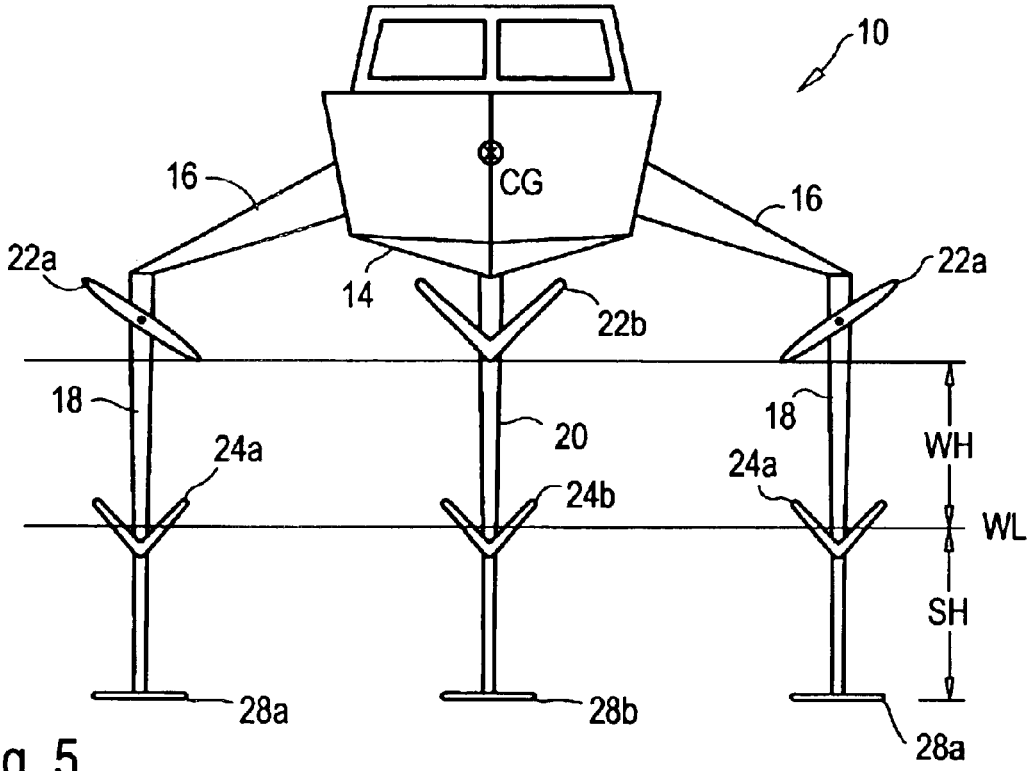
FIG. 5 is a front view of an alternative hydrofoil marine craft configuration of the present invention, including submerged hydrofoils.

As shown in FIG. 5, the hydrofoil marine craft 10 can further include a set of submerged foils 28*a* and 28*b*. The submerged foils 28*a* and 28*b* are mounted on the pylons 18 and 20 below the main foils 24*a* and 24*b*. The submerged foils 28*a* and 28*b* are configured to provide a lifting force such that the submerged foils 28*a* and 28*b* operating cooperatively with the main foils 24*a* and 24*b* to provide the all-up lift at the cruising speed. The submerged foils 28*a* and 28*b* partially uncouple the craft 10 from the effects of the waves, while maintaining the intrinsic stability provided by the surface piercing main foils 24*a* and 24*b*.

The submerged foils 28*a* and 28*b* are positioned a distance "SH" below the main foils 24*a* and 24*b*, where the distance "SH" is at least equal to or greater than "WH." In an exemplary embodiment, "SH" is substantially equal to four times the chord length of the submerged foils 28*a* and 28*b*.

Figure 6:
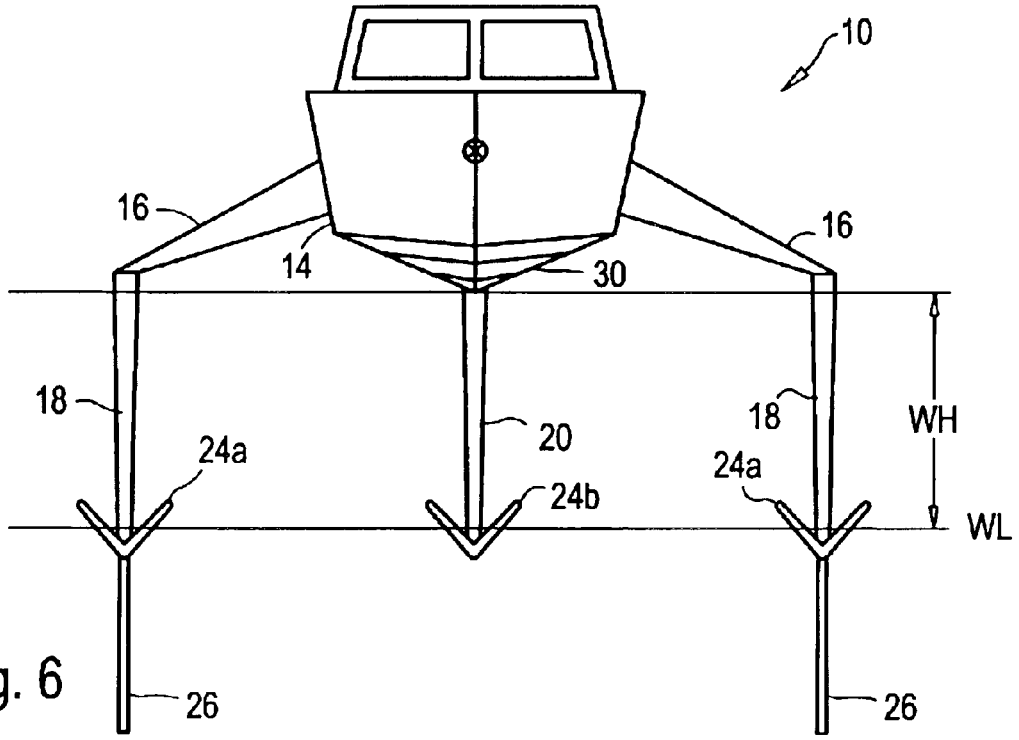
FIG. 6 is a front view of an exemplary hydrofoil marine craft including a planing hull configuration of the present invention.

In an alternative exemplary embodiment, as shown in FIG. 6, the hydrofoil marine craft 10 is a planing craft, where the craft's hull 14 is a planing hull capable of providing lift at lower speed, acting as an upper lift body 30. As the craft's speed is increased, the craft 10 rises to plane, raising a substantial portion of the craft's hull 14 above the waterline. As the speed is further increased, the lower lifting bodies, main foils 24*a* and 24*b*, produce sufficient lift to raise the craft 10 to the target cruise height. The distance "WH" is measured from the lowest point on the hull 14 to the waterline "WL" and is maintained at cruising speed.

The hydrofoil marine craft 10 can optionally include a tandem foil arrangement, including pairs of struts and hydrofoils positioned fore and aft of the craft's center of gravity and symmetrically about the craft's longitudinal centerline.

Alternatively, the hydrofoil marine craft 10 can optionally include a canard hydrofoil arrangement, having lifting bodies positioned fore of the crafts center of gravity along the craft's longitudinal centerline, and a pair lifting bodies positioned aft of the craft's center of gravity "CG", symmetrical about the craft's longitudinal centerline.

The hydrofoil marine craft 10 of the present invention is configured to optimally operate at a cruising height, where a height "WH" is maintained between the waterline "WL" and the upper lifting surfaces. As shown in FIG. 2, a propulsion system is provided to power the craft 10, where the propulsion system includes an engine 32 for providing thrust. As the main foils' 24*a* and 24*b* lift decreases, the height of the craft 10 will decrease, requiring an increase in thrust. As the main foils' 24*a* and 24*b* lift increases, the height of the craft 10 will increase, requiring a decrease in thrust.

A height measurement device 36 is included to indicate the craft's 10 height "CH" above the waterline "WL." The height measurement device 36 can be a height sensor configured for transmitting and receiving ultra sound waves, radio waves, or laser energy. The height can also be measured by an electromechanical device, electro-optical device, pneumatic-mechanical device, or other height measurement device known in the art. Alternatively, the height can be measured by a device mounted on a main foil 24*a* to detect the waterline "WL" position in relation to the mid span position of the foil 24*a*. The height measurement device 36 displays the craft's 10 height, enabling the operator to increase or decrease the thrust as needed.

Figure 7:
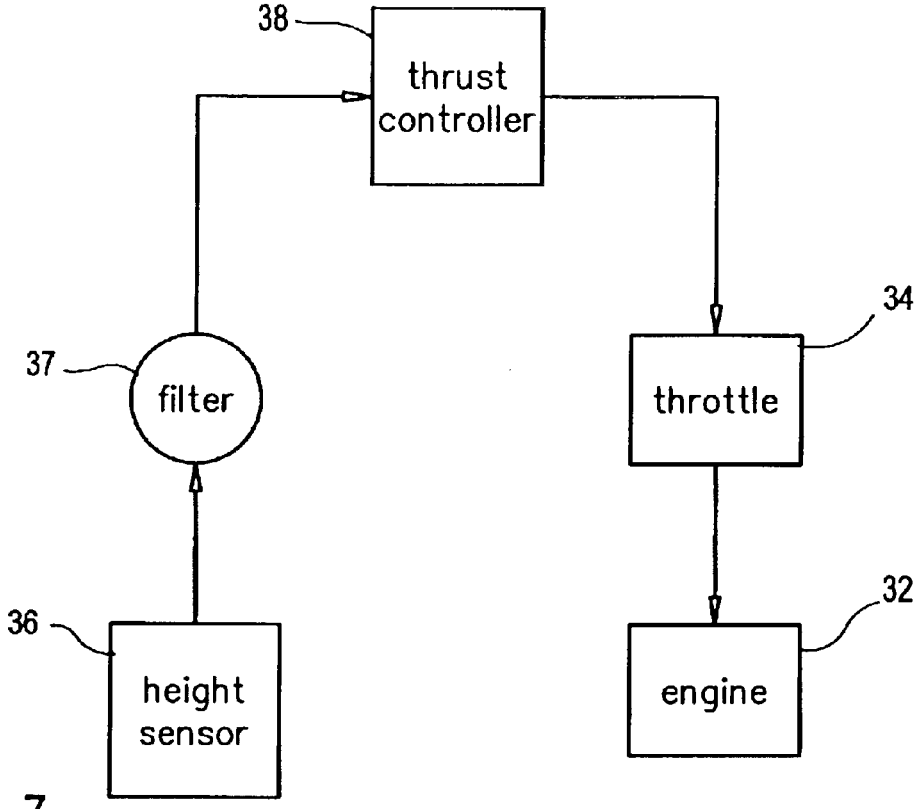
FIG. 7 is a flow chart for a variable thrust control system of the present invention.

The hydrofoil marine craft 10 can include a thrust controller 38. As shown in FIG. 7, a flow chart for the thrust controller 38, the thrust controller 38 is operably connected to the height measurement device 36, the engine 32, and the throttle 34. A filter 37 is interposed between the height measurement device and the thrust controller 38, where the filter 37 removes noise that can be caused by choppy or rough seas. The thrust controller 38 automatically adjusts the throttle 34, adjusting the engine's 32 output, in response to the craft's 10 height. As the height of the craft 10 decreases, the thrust controller 36 will increase in thrust, raising the craft 10. Similarly, as the height of the craft 10 increases, the thrust controller 38 decreases the thrust, lowering the craft. The thrust controller 38 optimally maintains the height of the craft 10, such that the distance "WH" is maintained between the upper lifting surface and the water line "WL."

The height of the craft 10 can be adjusted by changing the lifting forces acting on the main foils 24*a* and 24*b*. For example, the lifting forces acting on the main foils 24*a* and 24*b* can be adjusted by changing the angle of attack ω. Increasing the angle of attack ω will increase the lifting forces acting on the main foils 24*a* and 24*b*. Decreasing the angle of attack ω will decrease the lifting forces acting on the main foils 24*a* and 24*b*.

Figure 8:
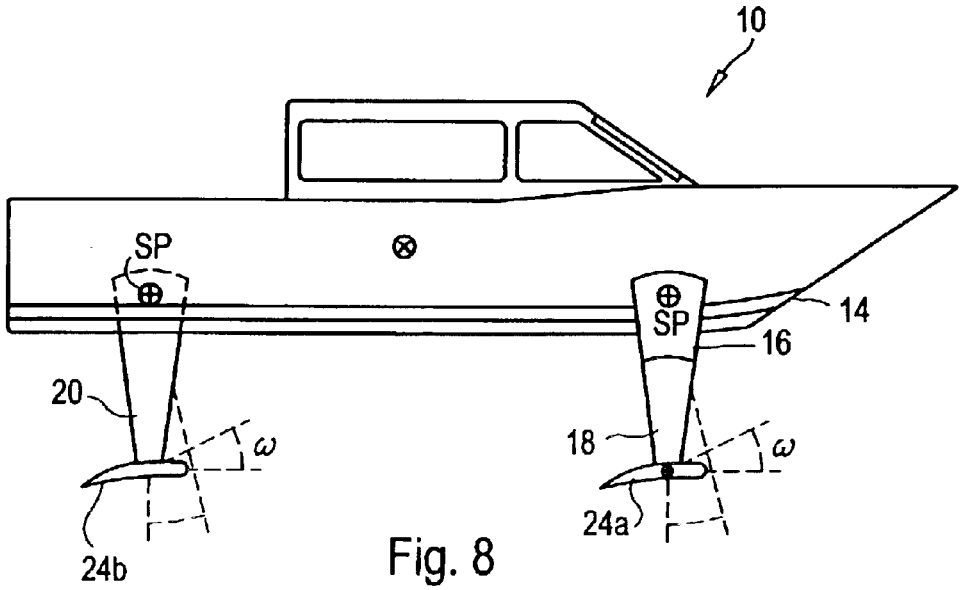
FIG. 8 is a side view of a hydrofoil marine craft including lower hydrofoil with an adjustable angle of attack configuration of the present invention.

As showing in FIG. 8, the main foils 24*a* and 24*b* are pivotally connected to the pylons 18 and 20, and are rotatable about pivot axis "FP". The angle of attack ω of the main foils 24*a* and 24*b* is adjusted by rotating the main foils 24*a* and 24*b* about the pivot axis "FP" to the desired angle of attack ω.

Alternatively, the pylons 18 and 20 are pivotally connected to the struts 16, or optionally to craft's hull 14, and rotatable about pivot axis "SP". The angle of attack ω of the main foils 24*a* and 24*b* is adjusted by rotating the pylons 18 and 20 about the pivot axis "SP", thereby increasing or decreasing the foils' angle of attack ω. Additionally, as the pylons 18 and 20 rotate about the pivot axis "SP", the angle of attack of the takeoff foils 22*a* and 22*b* will be simultaneously changed with the main foils' 24*a* and 24*b* angle of attack.

The main foils 24*a* and 24*b* can also be used to maintain pitch stability of the craft. The angle of attack of the fore main foil 24*a* or aft main foils 24*b* can be individual adjusted to maintain the craft at the appropriate pitch angle.

Figure 9:
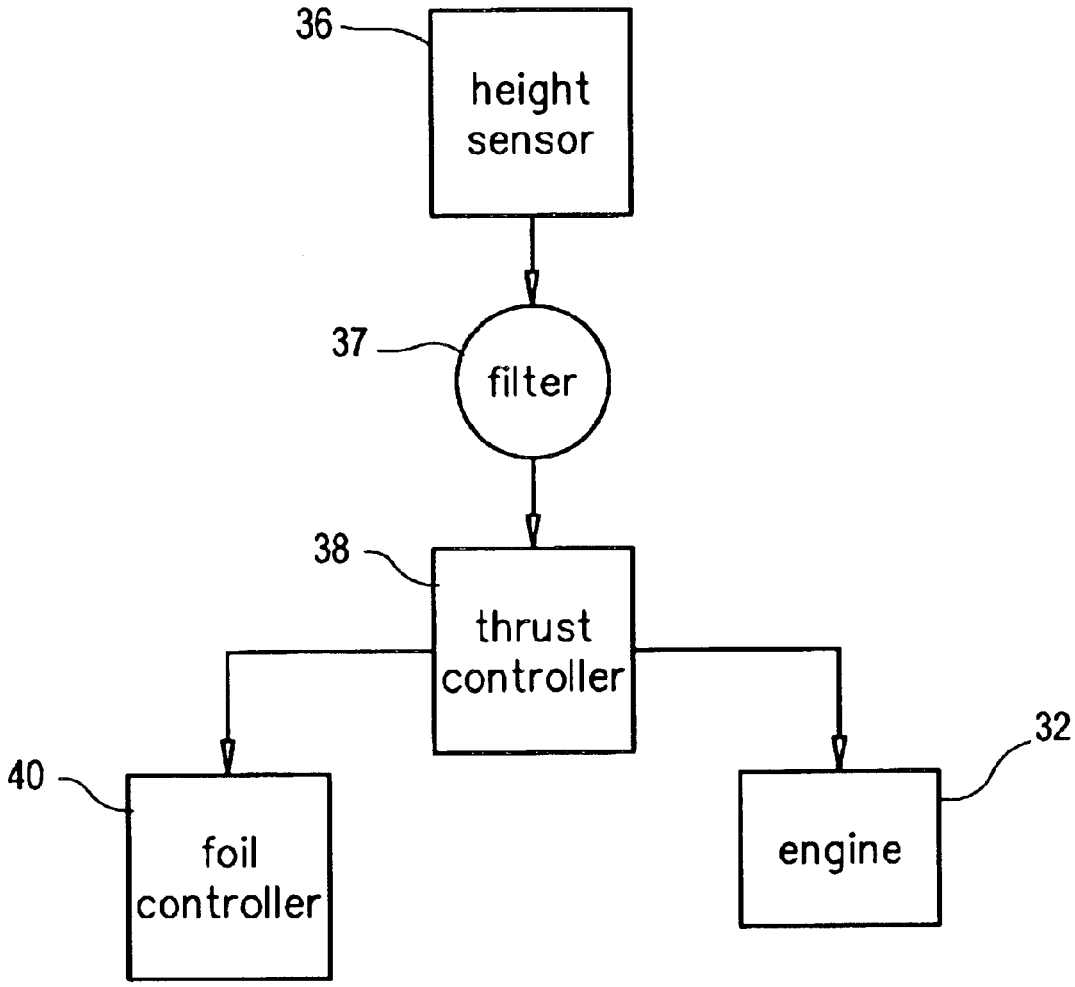
FIG. 9 is a flow chart for a cruise height control system of the present invention.

The height of the craft 10 can also be adjusted by simultaneously adjusting the thrust and the foils' angle of attack ω. As shown in FIG. 9, a flow chart for the thrust controller 38, the thrust controller is operably connected to the height indicator 36, the engine 32, and system for adjusting the foils' angle of attack 40. The thrust controller 38 automatically adjusts the engine's 32 output and foils' angle of attack ω in response to the craft's 10 height. As the height of the craft 10 decreases, the thrust controller 38 will increase the thrust and/or decrease the foils' angle of attack ω, raising the craft 10. Similarly, as the height of the craft 10 increases, the thrust controller 38 decreases the thrust and/or increases the foils' angle of attack ω, lowering the craft 10. The thrust controller 32 optimally maintains the height of the craft 10, such that the distance "WH" is maintained between the lower lifting surfaces and the water line "WL."

Figure 10:
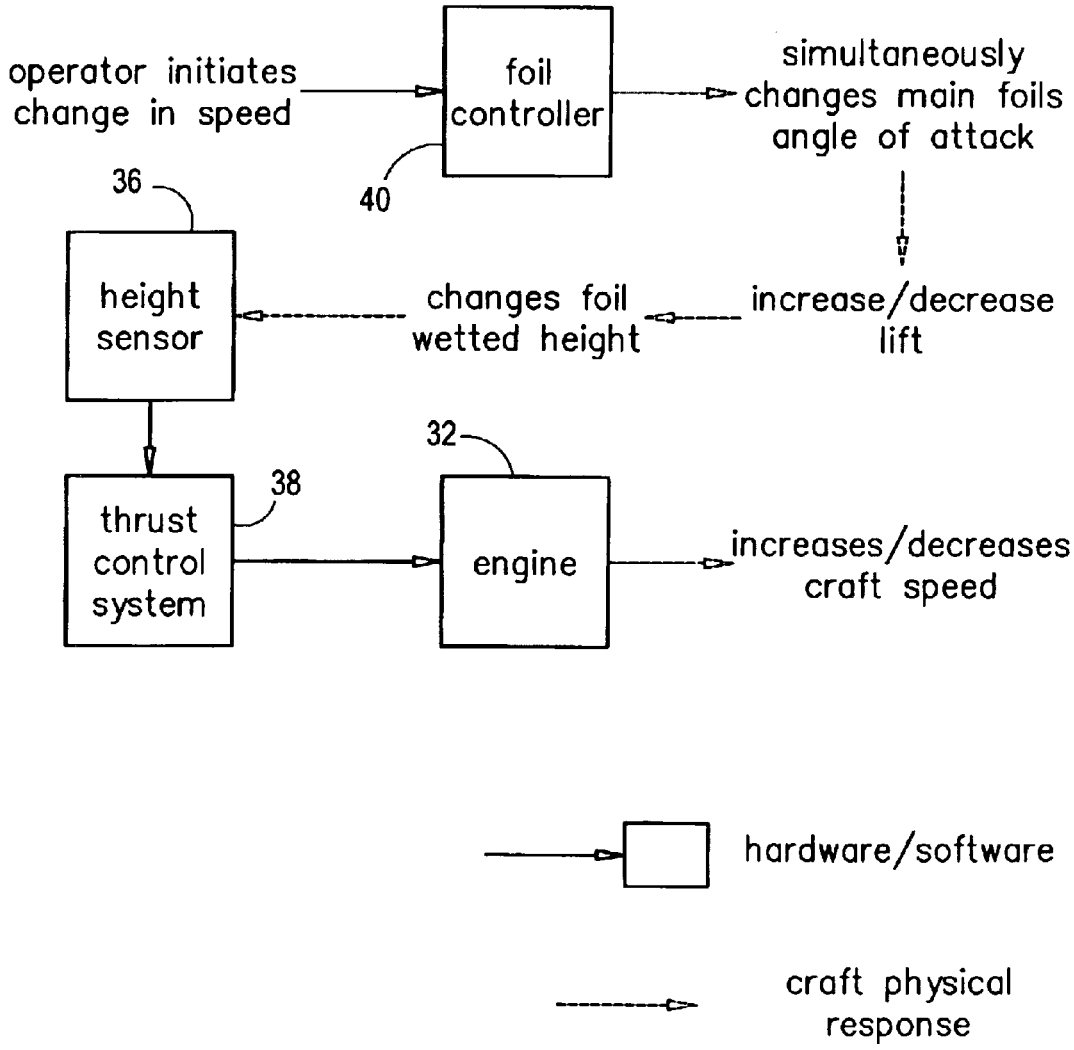
FIG. 10 is a flow chart for a cruise speed control system of the present invention.

Advantageously, the variable thrust/height control system can also be used to increase or decrease the cruising speed. As shown in FIG. 10, the operator can initiate a speed change by changing the angle of attack. The foil control 40 changes the angle attack of all main foils simultaneously. The change in the angel of attack results in an increase or decrease in the lifting force provided by the main foils, causing the waterline "WL" position to change on the main foils. The change in the height of the craft is detected by the height measurement device 36 and is transmitted to the thrust controller 38. In response, the thrust controller 38 adjusts the engine's 32 thrust achieving an increase or decrease in the cruising speed, while maintaining the craft at the target cruise height.

As shown in FIGS. 2 and 3, the propulsion system can include at least one air propeller 42 mounted to the deck 44 of the craft 10, were the air propeller 42 is operably connected to the engine 32. Alternatively, the propulsion system can include a water propeller, where a drive shaft is mounted through at least one of the pylons, operatively connecting the water propeller to the engine. Additionally, the propulsion system can be a water jet or a pump jet, and can include more than one air or water propellers.

The hydrofoil marine craft 10 further includes a direction control system for turning the hydrofoil marine craft 10. The direction of the hydrofoil marine craft 10 can be adjusted by selectively changing the lifting forces acting on the hydrofoils causing the hydrofoil marine craft 10 to roll onto a banked turn, such as by creating a lifting force differential between the starboard and port foils. For example, to make a starboard turn, a lifting force differential is created between the starboard foil and port foil, where the port foil has a greater lifting force than the starboard foil. As noted above, the lifting forces acting on the foils can be adjusted by differentially changing the angle of attack of the outboard foils. At a given speed, increasing the foil's angle of attack will increase the lifting forces action on the foils. Decreasing the angle of attack will decrease the lifting forces acting on the foils.

As showing in FIG. 8, the main foils 24*a* and 24*b* are pivotally connected to the pylons 18 and 20, and are rotatable about pivot axis "FP". The angle of attack ω of the main foils 24*a* and 24*b* are adjusted by rotating the main foils 24*a* and 24*b* about the pivot axis "FP" to the desired angle of attack ω.

Alternatively, as shown in FIG. 8, the pylons 18 and 20 are pivotally connected to the struts 16, or optionally to craft's hull 14, and rotatable about pivot axis "SP". The angle of attack ω of the main foils 24*a* and 24*b* is adjusted by rotating the pylons 18 and 20 about the pivot axis "SP", thereby increasing or decreasing the angle of attack ω.

Additionally, the small changes in the differential forces required to achieve a banked turn can by accomplished by adjusting control surfaces on the fore main foils 24*a* as is know in the art. For example, the fore main foils 24*a* can include a set of trim tabs, which when actuated change the fore main foil's 24*a* lift profile, differentially increasing or decreasing the lifting forces action on the main foils 24*a*.

Additionally, the vertical stabilizer 26 can be used as a rudder, providing directional control for the hydrofoil marine craft 10. In an exemplary embodiment, as shown in FIG. 6, a pair of vertical stabilizers 26 extends from the fore pylons 18, and are pivotal about a vertical axis "V." As the vertical stabilizers 26 are rotated about the vertical axis "V," the water flow over the vertical stabilizers 26 will cause the hydrofoil marine craft 10 to change directions. As shown in FIG. 4, a vertical stabilizer 36 can also pivotally extend from the aft pylon 20, functioning as a stand-alone rudder or in combination with the fore pylons 18.

In a still further embodiment, the craft's direction is controllable by directing the thrust. For example, the propulsion system can include a thrust directional controller.

The shock mitigation system for hydrofoil marine craft of the present invention has been exemplary described using a mono-hull craft. However, the shock mitigation system can also be applied to multi-hull craft, including catamarans and trimarans.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A hydrofoil craft configured to operate in a selected maximum wave height environment at a cruise height above a waterline, the hydrofoil craft comprising:

at least one upper lifting surface;

at least one lower lifting surface, wherein a vertical distance between the upper lifting surface and the waterline is at least one-half the selected maximum wave height when the hydrofoil craft is operating at the cruising height, with the selected maximum wave height being greater than zero; and at least one fore lower lifting surface and at least one aft lower lifting surface, wherein the fore lower lifting surface and aft lower lifting surface are dihedral hydrofoils, each having a submerged portion below the waterline and an exposed portion above the waterline.

2. The hydrofoil craft according to claim 1, wherein when the hydrofoil craft operates at the selected cruise height the submerged portion of the fore lower lifting surface and aft lower lifting surface are substantially equal to the exposed portions of the fore lower lifting surface and aft lower lifting surface.

3. The hydrofoil craft according to claim 1, wherein the at least one fore lower lifting surface and the at least one aft lifting surface each include a topmost edge and a bottommost edge, the at least one fore lower lifting surface topmost edge and the at least one aft lower lifting surface topmost edge are positioned at substantially equal distances above the waterline and the at least one fore lower lifting surface bottommost edge and the at least one aft lower lifting surface bottommost edge are positioned at substantially equal distances below the waterline.

4. The hydrofoil craft according to claim 1, further comprising at least one vertical stabilizer extending downward below the at least one aft lower lifting surface.

5. The hydrofoil craft according to claim 1, wherein the at least one upper lifting surface includes at least one fore upper lifting surface and at least one aft upper lifting surface.

6. The hydrofoil craft according to claim 5, wherein the fore upper lifting surface and aft upper lifting surface are dihedral hydrofoils.

7. The hydrofoil craft according to claim 1, wherein the hydrofoil craft includes a planing hull, the planing hull being the at least one upper lifting surface.

8. The hydrofoil craft according to claim 1, further comprising at least one fully submerged lifting surface positioned below the at least one lower lifting surface.

9. A hydrofoil craft configured to operate at a selected operational wave height comprising:

a hull defining a longitudinal centerline extending through the length of the hull and a center of gravity positioned along the centerline;

at least one fore foil set affixed to the hull forward of the hydrofoil craft's center of gravity; and at least one aft foil set affixed to the hull rearward of the hydrofoil craft's center of gravity, the at least one fore foil set and the at least one aft foil set each including substantially vertical pylon affixed to the hull, an upper foil and a lower foil attached to the vertical pylon, the upper foil being above the lower foil, wherein the vertical distance between the upper foils and the waterline is at least one-half the selected operational wave height when the hydrofoil craft is operating at a selected cruise height, the selected operational wave height being greater than zero, wherein the lower foils are dihedral foils each defining a foil span length, such that at the selected cruise height the waterline is at about 33% to 80% of the lower foil span length.

10. The hydrofoil craft according to claim 9, wherein the waterline is at about 50% of the lower foil span length.

11. The hydrofoil craft according to claim 9, wherein the at least one fore foil set is affixed to the hull along the hull longitudinal centerline.

12. The hydrofoil according to claim 9, wherein the at least one fore foil set comprises a pair of forward foil sets symmetrically affixed to the hull orthogonal to the longitudinal centerline of the hull.

13. The hydrofoil craft according to claim 9, wherein the at least one aft foil set is affixed to the hull along the hull's longitudinal centerline.

14. The hydrofoil craft according to claim 13, further comprising at least one vertical stabilizer extending downward from the vertical pylon below the at least one aft lower lifting surface.

15. The hydrofoil according to claim 9, wherein the at least one aft foil set comprises a pair of aft foil sets symmetrically affixed to the hull orthogonal to the longitudinal centerline of the hull.

16. The hydrofoil craft according to claim 9, further comprising at least one fully submerged foil positioned below the fore lower foil.

17. The hydrofoil craft according to claim 9, further comprising at least one fully submerged foil positioned below the aft lower foil.

* * * * *